US005207417A

United States Patent [19]

Bell et al.

[11] Patent Number: 5,207,417

[45] Date of Patent: May 4, 1993

[54] ACTIVE COPY SHEET CATCH AND STACKING DEVICE

[75] Inventors: Conrad J. Bell; Ronald G. Buckner, both of Webster, N.Y.

[73] Assignee: Xerox Corporation, Stamford, Conn.

[21] Appl. No.: 861,666

[22] Filed: Apr. 1, 1992

[51] Int. Cl.[5] ..... B65H 29/54

[52] U.S. Cl. ..... 271/175; 271/220; 271/209; 271/185

[58] Field of Search ..... 271/175, 178, 184, 185, 271/188, 209, 220, 221, 222

[56] References Cited

U.S. PATENT DOCUMENTS 4,804,174 2/1989 ter Horst ..... 271/209 X
5,040,777 8/1991 Bell et al. ..... 271/3

FOREIGN PATENT DOCUMENTS 1145553 3/1963 Fed. Rep. of Germany ..... 271/178
0197269 8/1989 Japan ..... 271/209

*Primary Examiner*—H. Grant Skaggs
*Assistant Examiner*—Carol Lynn Druzbick

[57] ABSTRACT

A catch tray for a copier/printer holds and stacks copies of a wide variety of sizes exiting a copier/printer without operator involvement. The copies are allowed to fall into a funnel type baffling device with flexible friction paddles that drive the incoming copies into the catch tray and holds them in place while simultaneously allowing a major portion of each copy sheet to flip and hang down over a curved portion of the outer wall of the catch tray.

16 Claims, 2 Drawing Sheets

ACTIVE COPY SHEET CATCH AND STACKING DEVICE

This invention relates to a copier/printer machine that prints page image information onto copy sheets sizes A through E (A4–A0 metric), such as, in U.S. Pat. No. 5,040,777 which is incorporated herein by reference, and more particularly, to an improved catch tray or stacking device for such a machine.

Heretofore, copy sheet catch trays on wide format copier/printers that are used to copy engineering drawings have required an operator to manually adjust the size of the catch tray according to the size of original documents being fed into the machine. In order to make the operator more efficient and the copying process less labor intensive, a need exists for an improved copy sheet catch tray.

It is therefore an object of this invention to provide a copy sheet catch tray for catching and holding a variety of wide copy sheets without operator involvement.

Therefore, the present invention provides a catch tray attached to the copier/printer that is adapted to easily stack a wide variety of copy sheet sizes without operator involvement. The copy sheet catch tray is configured to allow copy sheets to fall into a funnel type baffle device that has flexible friction paddles that drive the copy sheets down into a fixed depth of the catch tray and holds each copy sheet as the remaining portion of each copy sheet falls over the baffle to hang freely downward. There is a highly frictioned nub over the baffle to create friction to copy sheet movement.

Figure 1:
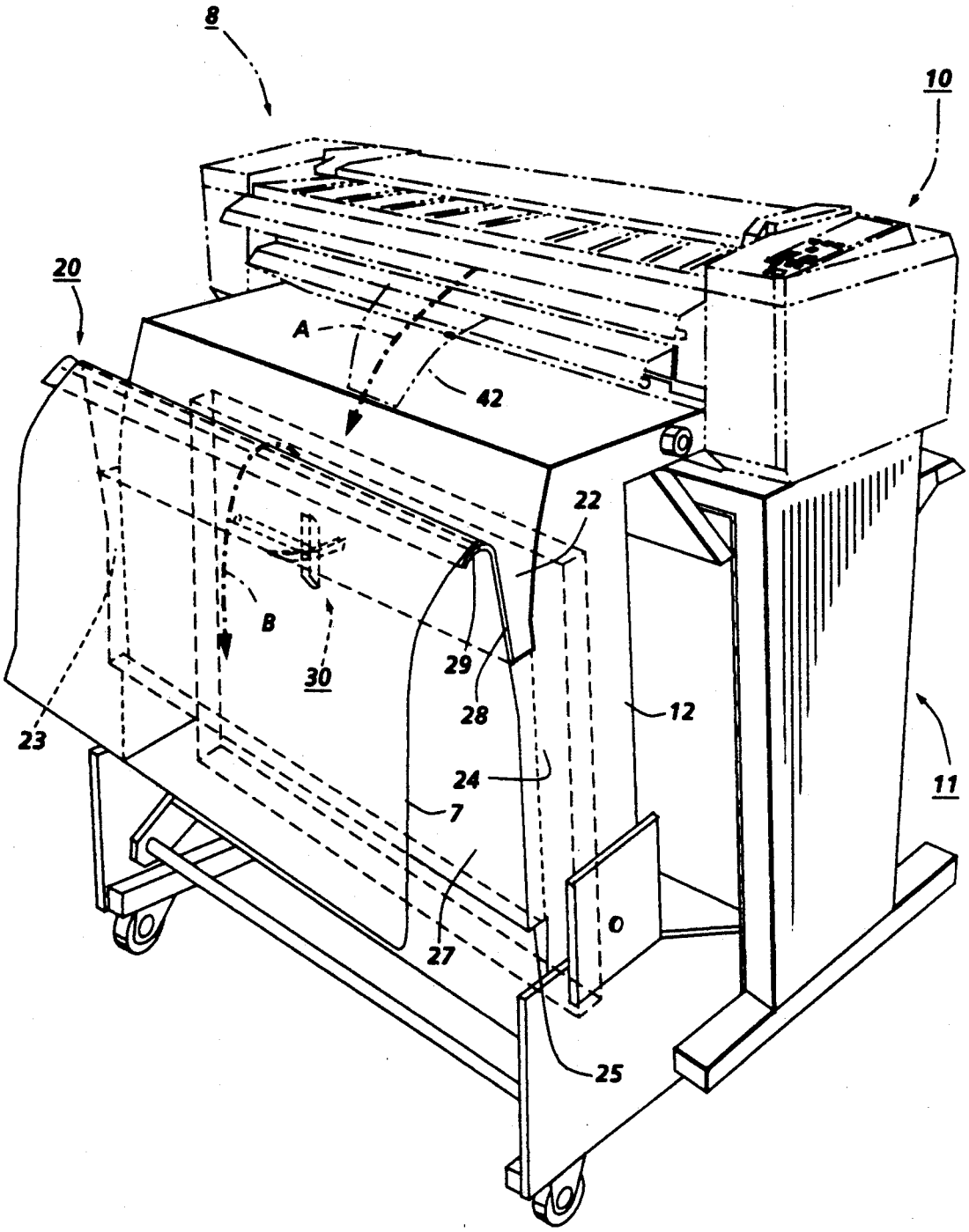
FIG. 1 is a schematic isometric view of the copy sheet catch tray of the present invention with a copier/-printer shown in phantom.

Referring now to the drawings in detail, and wherein like numbers indicate like elements, copy sheet catch tray or stacking device 20 is shown in FIG. 1 attached to a copier/printer 8 in phantom as shown in U.S. Pat. No. 5,404,777. Conventional copying machine 8 has a xerographic section 10 mounted on a support stand 11 and a copy sheet input or feed section 12. The catch tray 20 is substantially rectangular in shape and includes an upstanding back or rear wall 22 connected to a copy sheet support member or base 25 which in turn is connected to an upstanding front wall 27 that has a baffle 28 extending away from a vertical plane and front wall 27 at an acute angle and forms a funnel shaped entrance to the catch tray and a lip 29 connected to it. A frictioned nub 26, for example, a silicone elastomer, is placed over a portion of baffle 28 to create friction to copy sheet movement. Side walls 23 and 24 enclose the catch tray. Catch tray 20 has a compartment 21 for catching copy sheets as they exit the machine. The lead edges of copy sheets 7 are guided in the direction of arrow A by baffle means 42 as they are transported by machine 8 from xerographic section 10 into compartment 21 of the catch tray with continued transport of the copy sheets by the machine causing a trail edge portion of each copy sheet to flip away from the machine and over angled lip portion 29 of the catch tray.

Figure 2:
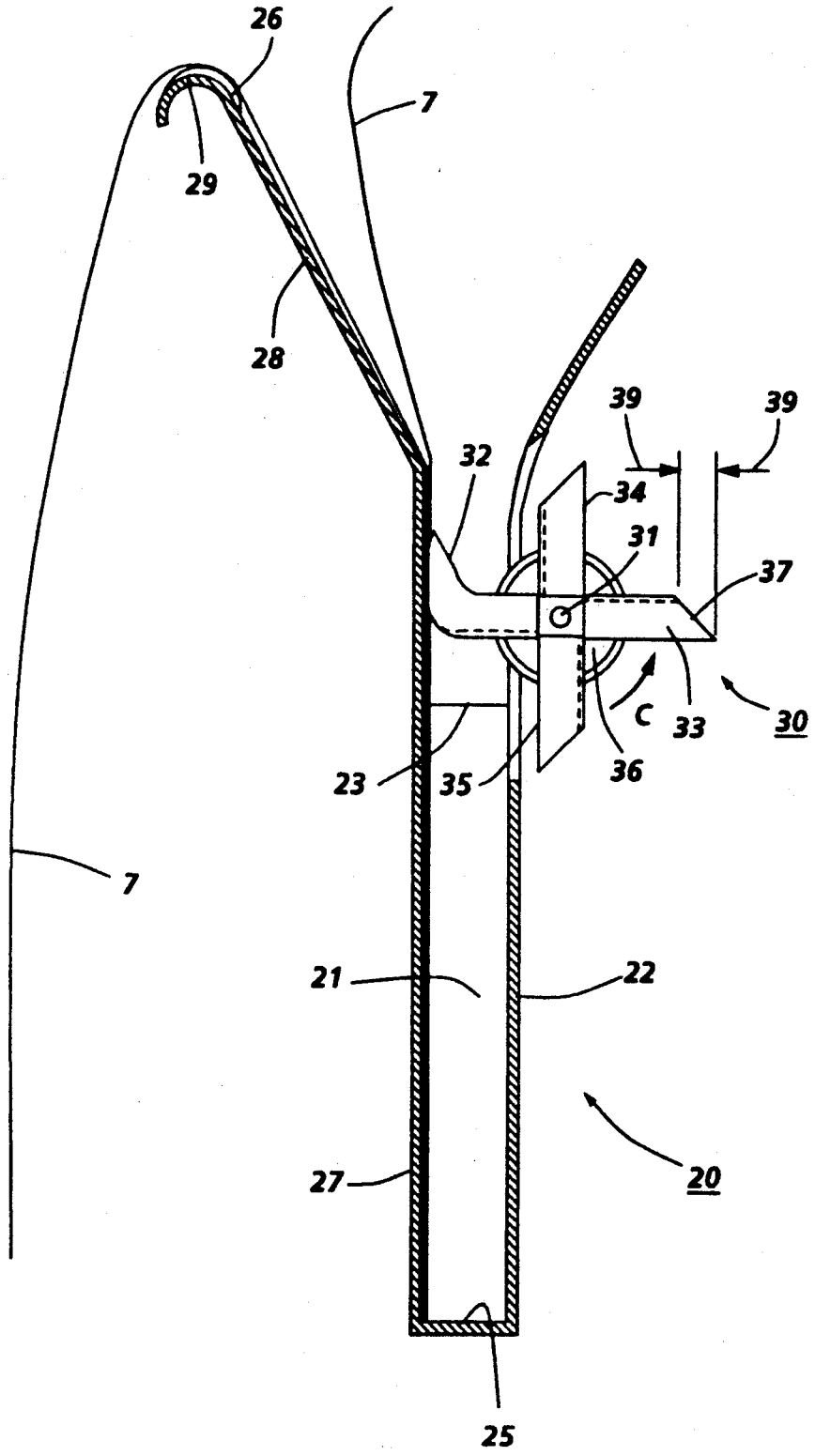
FIG. 2 is an enlarged, partial side view of the copy sheet catch tray of FIG. 1 showing a flexible paddle wheel driving a sheet into and holding the sheet within the catch tray.

Paddle wheels 30 of FIG. 2 are positioned within compartment 21 of catch tray 20 and mounted on a shaft 31 for rotation in the direction of arrow C and are adapted through flexible paddles 32, 33, 34 and 35 to drive copy sheets down into a fixed depth against base 25 of the catch tray. The functional area of paddles 32, 33, 34 and 35 of paddle wheels 30 is a slanted portion 37 at the tip of the paddles that conforms to the inside surface of upstanding front wall 27 when in a stressed state. This functional area is bounded by arrows 39. Conventional drive motor 36 for the paddle wheels is engaged at the proper time and cycled as required or ON when required. A single paddle wheel or a plurality of paddle wheels could be mounted on shaft 31, as desired. This tray could also be used to catch original documents exiting the machine.

Catch tray 20 catches and holds all copy sheets of all sizes entering the tray from a source without operator adjustments or assistance. This is accomplished by allowing copy sheets exiting a source to fall into the funnel shaped opening to the catch tray formed by portions of front and rear walls 27 and 22, respectively, that are angled away from vertical portions of both walls. The flexible friction paddles 32 and 33 drive the copy sheets down against bottom copy sheet support surface 25 which prevents them from further travel and holds them as the remaining portion of the copies fall over lip or radius 29 in the direction of arrow B and hang downward out of the way of an operator. Successive copies enter the catch tray on top of preceding copies and fall also. This allows various sizes of copy sheets to stack at the same or different times without the operator having to make adjustments to the catch tray. After all copies of a particular job have been made, the copies are grasped at the sides of the stack and removed as the paddles, that were holding the copies, flex to allow their removal all at once. The fixed depth and height of the catch tray from the floor are determined by the normal size of the copy sheets that the copier/printer utilizes.

This invention has been described in detail with particular reference to a preferred embodiment thereof, but it will be understood that variations and modifications can be effected within the spirit and scope of the invention and all such variations and modifications are intended to be covered by the appended claims.

What is claimed is:

1. An active copy sheet catch tray for a copier/-printer, comprising:

upstanding stationary front and rear walls with upper portions thereof forming a funnel like entrance to the catch tray that is wider than the remaining portions of said upstanding walls;

side walls connected to said front and rear walls;

a copy sheet support surface connected to said front, rear and side walls; and paddle wheel means positioned at a predetermined location within said front and rear walls and adapted for driving copy sheets exiting the copier/-printer onto said copy sheet support surface, while simultaneously holding the copy sheets and allowing trail edges of the copy sheet to fall due to gravity over said front wall and hang downward.

2. The active copy sheet catch tray of claim 1, wherein said front wall includes a curvilinear lip portion over which the copy sheets hang downward.

3. The active copy sheet catch tray of claim 2, wherein said lip portion of said front wall has a frictioned material attached to the surface thereof that is adjacent the first copy sheet to provide a frictional surface to the first copy sheet and thereby prevent movement of the copy sheets.

4. The active copy sheet catch tray of claim 1, wherein said paddle wheel means includes a single paddle wheel.

5. The active copy sheet catch tray of claim 1, wherein said paddle wheel means includes a plurality of paddle wheels.

6. A copier/printer including an active copy sheet catch tray that is adapted to easily stack a wide variety of copy sheet sizes without operator involvement comprising:

upstanding stationary front and rear walls with upper portions thereof forming a funnel like entrance to the catch tray;

side walls connected to said front and rear walls;

a copy sheet support surface connected to said front, rear and side walls; and paddle wheel means positioned at a predetermined location within said front and rear walls and adapted for driving copy sheets exiting the copier/-printer onto said copy sheet support surface, while simultaneously holding the copy sheets and allowing trail edges of the copy sheet to fall due to gravity over said front wall and hang downward.

7. The copier/printer active copy sheet catch tray of claim 6, wherein said front wall includes a lip portion over which the copy sheets hang downward.

8. The copier/printer of claim 7, wherein said lip portion of said front wall of said active copy sheet catch tray has a frictioned material attached to the surface thereof that is adjacent the first copy sheet to provide a frictional surface to the first copy sheet and thereby prevent movement of the copy sheets.

9. The copier/printer claim 6, wherein said active copy sheet catch tray of paddle wheel means includes a single paddle wheel.

10. The copier/printer of claim 6, wherein said active copy sheet catch tray paddle wheel means includes a plurality of paddle wheels.

11. The copier/printer active copy sheet catch tray of claim 6, wherein said funnel like entrance to the catch tray comprises baffles that flair away from said upstanding front and rear walls at acute angles with respect to a vertical plane.

12. The copier/printer active copy sheet catch tray of claim 6, wherein said paddle wheel means includes a tip portion thereof that conforms to the inside surface of said front will when in a stressed state.

13. The copier/printer active copy sheet catch tray of claim 12, wherein said paddle wheel means is stressed against each individual sheet as the sheets enter the catch tray in order to drive each individual sheet onto said copy sheet support surface while simultaneously holding the sheets against movement within the catch tray.

14. An active copy sheet catch tray that is adapted to easily stack a wide variety of copy sheets sizes simultaneously without operator involvement, comprising;

upstanding stationary front and rear walls with upper portions thereof forming a funnel like entrance to the catch tray;

side walls connected to said front and rear walls;

a copy sheet support surface connected to said front, rear and side walls; and paddle wheel means positioned at a predetermined location within said front and rear walls and adapted for driving copy sheets exiting the copier/-printer onto said copy sheet support surface, while simultaneously holding the copy sheets and allowing trail edges of the copy sheet to fall due to gravity over said front wall and hang downward.

15. An active catch tray for catching document/copy sheets exiting a reproduction machine, comprising:

upstanding front and rear walls with upper portions thereof that are wider than the remaining portions of said upstanding walls;

side walls connected to said front and rear walls;

a document/copy sheet support surface connected to said front, rear and side walls; and at least one paddle wheel positioned at a predetermined location within said front and rear walls and adapted for driving document/copy sheets exiting the reproduction machine onto said document/-copy sheet support surface, said paddle wheel including flexible blades that as they are rotated tip portions thereof conform to an inside surface of said front wall in order to simultaneously drive each individual sheet onto said document/copy sheet support surface and hold the document/copy sheets within the catch tray.

16. The active catch tray of claim 15, wherein said at least one paddle wheel is positioned so as to allow trail edges of the document/copy sheets to fall due to gravity over said front wall and hang downward.

* * * * *